US006766624B2

(12) United States Patent
Shibazaki et al.

(10) Patent No.: US 6,766,624 B2
(45) Date of Patent: Jul. 27, 2004

(54) CONTROLLER IN A BANDING PACKING MACHINE

(75) Inventors: Tokio Shibazaki, Kawasaki (JP); Yosikatsu Aizawa, Kawasaki (JP); Mitsuru Sato, Kawasaki (JP); Kenichi Enda, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 10/003,367

(22) Filed: Nov. 15, 2001

(65) Prior Publication Data

US 2002/0056252 A1 May 16, 2002

(30) Foreign Application Priority Data

Nov. 16, 2000 (JP) ..... 2000-349829

(51) Int. Cl.[7] ..... B65B 57/00; B65B 13/18

(52) U.S. Cl. ..... 53/52; 53/589; 100/4; 100/26

(58) Field of Search ..... 53/52, 399, 589; 100/1–34

(56) References Cited

U.S. PATENT DOCUMENTS 4,836,873 A * 6/1989 Mitanihara et al. ..... 100/4
4,850,179 A 7/1989 Takami
4,903,456 A * 2/1990 Meur ..... 53/52
4,912,908 A * 4/1990 Sakaki ..... 100/29
4,912,912 A * 4/1990 Tagomori ..... 53/589
5,123,226 A * 6/1992 Near ..... 53/75
5,560,187 A * 10/1996 Nagashima et al. ..... 53/589
5,809,873 A * 9/1998 Chak et al. ..... 100/4
5,884,453 A * 3/1999 Ramsey et al. ..... 53/587
6,301,862 B1 * 10/2001 Yuyama et al. ..... 53/562

FOREIGN PATENT DOCUMENTS

FR 2615480 A * 11/1988 ..... B65B/13/18
GB 2019040 A * 10/1979 ..... B65B/13/18
JP 64-058613 A * 3/1989 ..... B65B/13/18
JP 11-292011 A * 10/1999 ..... B65B/13/18

* cited by examiner

*Primary Examiner*—Shephen F. Gerrity
(74) *Attorney, Agent, or Firm*—Webb Ziesenheim Logsdon Orkin & Hanson, P.C.

(57) ABSTRACT

A controller in a banding packing machine which can easily correct a shift from the predetermined timing cycle. The controller includes a cam shaft having a plurality of cams, a timing plate which includes a plurality of holes corresponding to rotation positions of the cam shaft, and a detecting means. An inching mode is also disclosed which provides for the manual adjustment of presser members following a step in the rotation of the cam shaft.

2 Claims, 3 Drawing Sheets

CONTROLLER IN A BANDING PACKING MACHINE

BACKGROUND OF THE INVENTION

1. Field of the Invention

The present invention relates to a banding packing machine and more particularly to a controller in a banding packing machine which controls cutting, welding and the like for binding a band in a predetermined timed cycle.

2. Description of the Prior Art

In an automatic or semi-automatic banding packing machine, a band led from a band reel is wound upon an object to be packed and is then clamped, and subsequently, is returned to the band feeding side and is tightened. Then, a bound portion of the band is melted by a heater almost simultaneously with the cutting and is then bonded by means of a press. These operations are carried out continuously and instantaneously in one cycle.

In such a banding packing machine, a control portion utilizing a cam is provided to precisely carry out the operations. The control portion controls the timing of the operations of the band packing machine. More specifically, a plurality of cams are provided on one cam shaft of the control portion. When the cams are rotated with the cam shaft, cam followers corresponding to the cams are moved vertically so that a plurality of members carry out their predetermined operations, such as clamping, return, tightening and the like.

When a large number of operations are to be thus carried out continuously in a short time period, the band is insufficiently gripped and the band cannot be sufficiently returned if member positions become shifted during the operation of the cam and the cam follower, or during the operation of a roller and a touch roller.

When an operation failure occurs in any of these operations in a conventional banding packing machine, it is necessary to stop all driving operations at once. The cam shaft must then be manually rotated to perform a banding operation. Specifically, in order to determine whether or not related members are set in their proper positions, the cam shaft must be rotated to each of its original position, a reverse rotation start position, a tightening start position, a normal rotation start position and the like on the cam shaft.

However, it is time and labor intensive to manually rotate the cam to each position and confirm an accurate positional relationship. Furthermore, it is difficult to decide whether or not a stop position is reached after the manual rotation is in a normal position.

SUMMARY OF THE INVENTION

In view of the foregoing, it is an object of the present invention to provide a controller in a banding packing machine which can regulate an operation distance by a link operation, and can easily correct a shift from the predetermined, correct timed cycle.

In order to attain this object, the present invention provides a controller in a banding packing machine, comprising:

a cam shaft which is rotated upon receipt of force from a driving source;

a plurality of cams provided on the cam shaft;

a timing plate provided on the cam shaft, said timing plate having a hole formed thereon which corresponds to a predetermined position so that a rotation position of the cam shaft can be detected; and a detecting means for detecting that the hole formed on the timing plate has reached the predetermined position, and an inching mode which stops the rotation of the cam shaft when the detecting means detects the hole formed on the timing plate.

With such a structure, it is possible to ascertain whether or not a related member is in its proper predetermined position by setting the inching mode to occur when the hole formed on the timing plate reaches a predetermined position. In the case when the related member does not have a predetermined positional relationship, it is preferable that the power source be turned off a single time to regulate the position.

It is preferable that the following two modes be switchable: (1) the inching mode for stopping the rotation of the cam shaft when the detecting means detects the hole of the timing plate; and (2) the operation mode for causing the detecting means to detect the hole of the timing plate, thereby driving the cam shaft in a normal cycle.

If the inching mode and the operation mode can be thus switched, the inching mode is set before a first operation is carried out and it is ascertained whether or not the inching mode is set in the normal condition. If the inching mode is set in the normal condition, the operation mode may be exactly set to carry out a continuous operation. On the other hand, if the positional relationship is not accurate, it is preferable that the position regulation be performed again and the operation mode then be set.

As described above, when the inching mode is set, the controller in the banding packing machine in accordance with the present invention makes it possible to determine, at each time, whether or not the positional relationship of each member is set in a correct position.

Accordingly, it is possible to easily adjust the positional relationship between the members.

These objects as well as other objects, features and advantages of the present invention will become more apparent to those skilled in the art from the following description with reference to the accompanying drawings.

DETAILED DESCRIPTION OF THE INVENTION

An embodiment of the present invention will be described below with references to the drawings.

Figure 1:
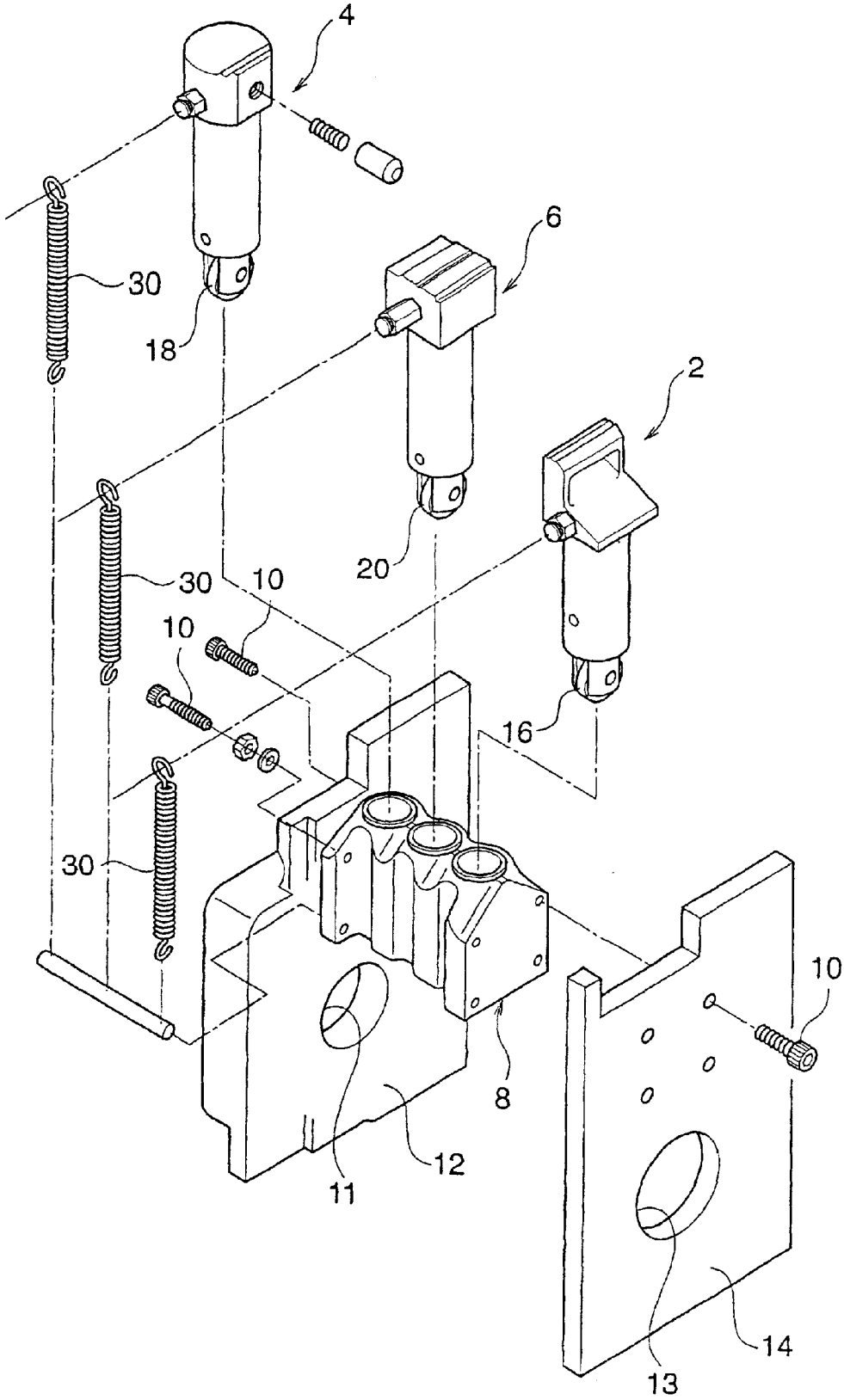
FIG. 1 is an exploded perspective view showing a control portion in a banding packing machine according to an embodiment of the present invention.

FIG. 1 shows a control portion in a banding packing machine for performing an operation for clamping, welding and cutting a tip portion of a band.

In the control portion, a right presser member 2, a left presser member 4 and a middle presser member 6, which are vertically moved by the operation of a cam mechanism, are accommodated in a support block 8, and the support block 8 is supported between a pair of fixed plates 12 and 14 through a screw member 10 or the like.

Figure 2:
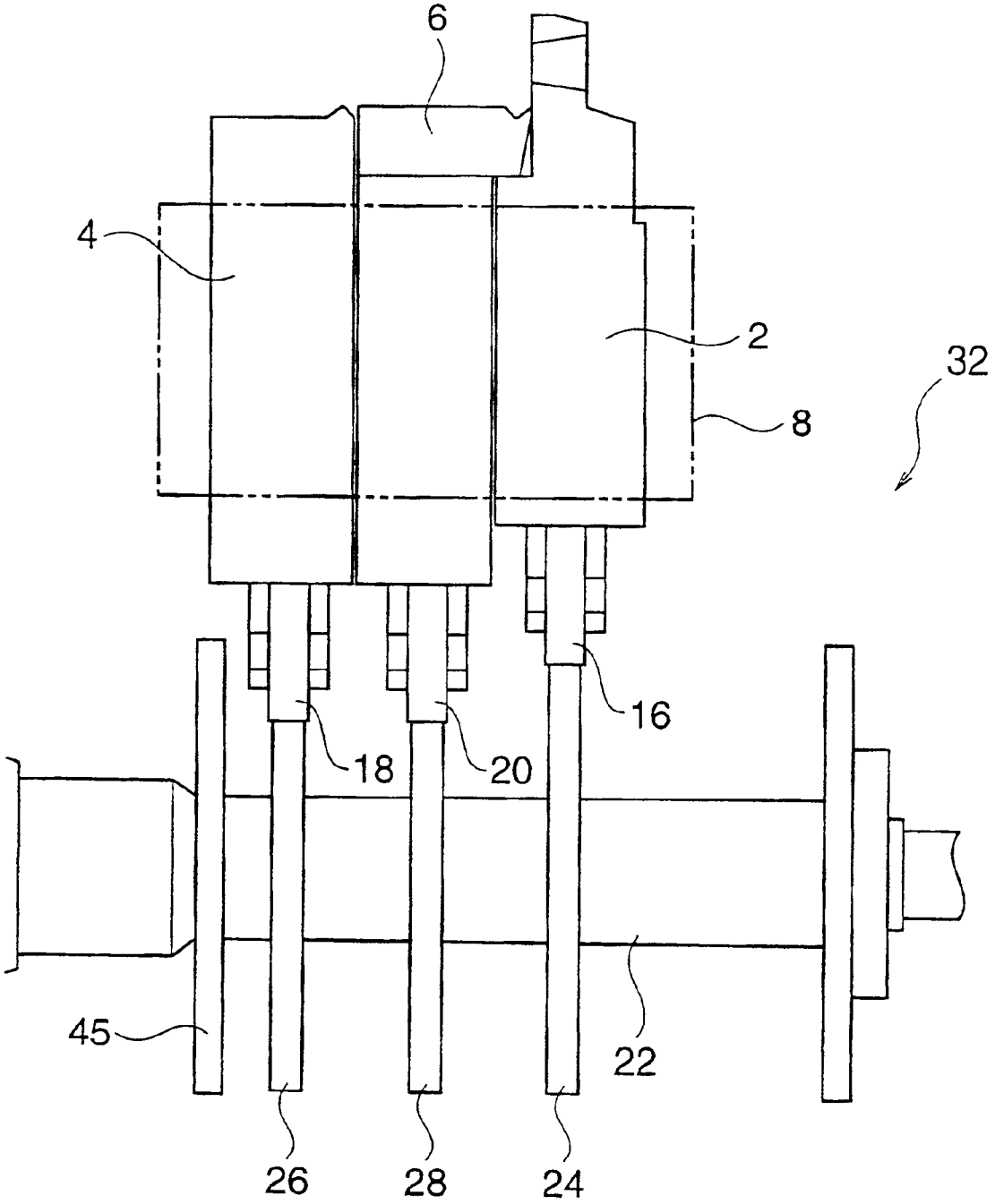
FIG. 2 is a front view showing a state in which the control portion according to the embodiment is assembled.

As shown in FIG. 2, a cam shaft 22 is rotatably supported on shaft insertion holes 11 and 13 formed on the fixed plates 12 and 14. The cam shaft 22 is rotated upon receipt of the force of a driving source such as a motor which is not shown. Cam followers 16, 18 and 20 are attached to the lower parts of the right presser member 2, the left presser member 4 and the middle presser member 6, respectively. In addition, these cam followers 16, 18 and 20 abut on the peripheral surfaces of cams 24, 26 and 28 provided on the cam shaft 22. The cam followers 16, 18 and 20 are pulled toward the cam side with spring 30 so that they are maintained in a position which abuts on the cams. A timing plate 45 is fixed integrally with the cam shaft 22.

Figure 3:
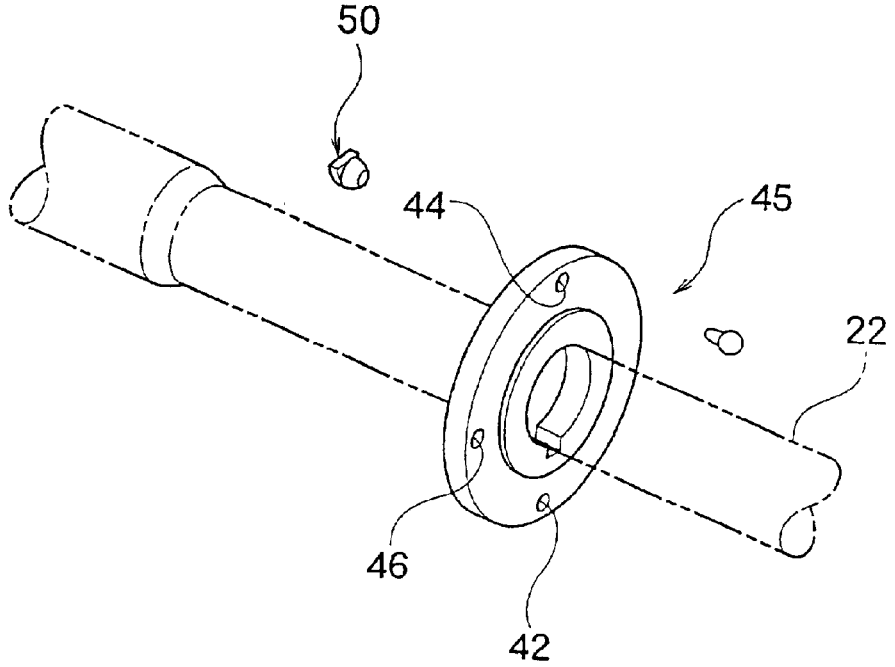
FIG. 3 is a perspective view showing a timing plate fixed to a cam shaft.

The position of the cams 24, 26 and 28, and members to be operated by the cams, can be confirmed by the timing plate 45, when the cams 24, 26 and 28 supported on the cam shaft 22 are rotated. For example, three holes 42, 44 and 46 are formed apart from each other at predetermined intervals as shown in FIG. 3. For example, the detection of the holes 42, 44 and 46 indicates the start of each step. If the rotation of the cam shaft 22 is stopped when the hole 42 is detected, it is possible to identify the positional relationship between the members for the start of a next step.

Accordingly, if the cam shaft 22 is placed in an original position when the hole 42 is detected, for example, it is possible to ascertain whether or not the right presser member 2, the left presser member 4 and the middle presser member 6 are set in their proper original position.

Accordingly, if the position is correct at that time, a signal for the original position can be output with the correct timing cycle.

Figure 4:
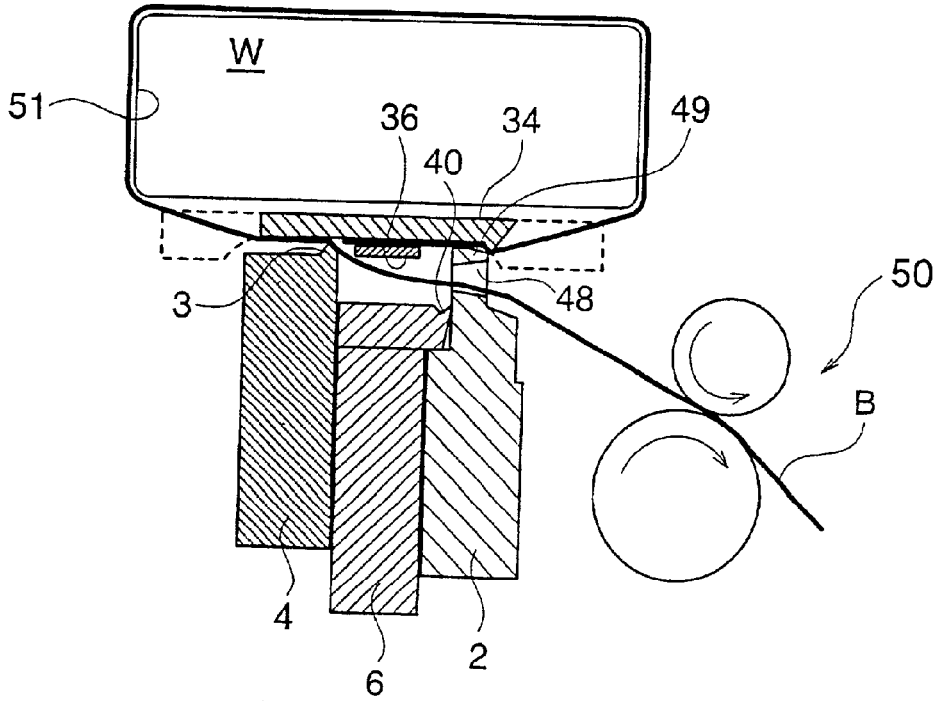
FIG. 4 is a sectional view showing an operation for carrying out banding by means of the control portion according to the present embodiment.

As shown in FIG. 4, the band B is inserted into a guide hole 48 of the right presser member 2 by the driving force of a band feeding roller 50. When the tip of the band B is passed through the band arch 51 and abuts on a stopper (not shown) by the driving force of the band feeding roller 50, the right presser member 2 is lifted to interpose the band B between the non-slip portion 49 and the slide table 34.

Thereafter, the band feeding means 50 is reversed in the directions of the arrows in FIG. 4 to pull the band B. Consequently, the band B is forcibly removed from a band guide arch 51 and is wound onto an object W to be packed. When the band B is wound onto the object W to be packed, band B is further pulled and tightened. After the band B is thus tightened, the left presser member 4 is moved to an uppermost position to interpose the binding rear end side of the band B between the non-slip portion 3 of the left presser member 4 and the slide table 34. In this state, the binding tip portion of the band B and the binding rear end portion are opposed to each other with a space maintained vertically. A heater 36 is inserted in the space, thereby melting the surface of the band B. When the surface of the band B is molten, the middle presser member 6 is lifted to push the molten portion thereagainst and is bonded thereto. At this time, the cutting blade 40 of the middle presser member 6 cuts the band B together with the right presser member 2.

Thus, a series of banding works are carried out. If the heater 36 shown in FIG. 4 is supposed to protrude from the side when the hole 44 is detected, it is necessary to adjust its location if the heater 36 is not in a protruded position when the hole 44 is detected. In the present embodiment, an inching mode is set so that the rotation of the cam shaft 22 is stopped when detecting means 50 detects the hole 44. Therefore, it is possible to easily ascertain whether or not the heater 36 has protruded correctly.

In prior art banding packing machines, usually, when the power source is turned on, a normal cycle of operation occurs, which involves the clamping, return and tightening of a band, and then the pressure weld of the band through the heater, in that order. Therefore, even if the heater 36 has not protruded in its original position, the cam shaft 22 passes by the same position and is rotated differently from the present invention. In the present invention, the cam shaft 22 stops rotating every time the holes 42, 44 and 46 are detected. Therefore, it is possible to ascertain whether or not each member is placed in a correct position.

In the control portion according to the present invention the inching mode for adjusting the positional relationship between the members is provided. Therefore, it is possible to ascertain whether or not the positional relationship has deviated during the stop.

In the proper condition, moreover, it is preferable that the operation mode should be exactly set to carry out a continuous operation.

Furthermore, if the inching mode and the operation mode can be thus switched, the operation mode can be set to immediately operate the banding packing machine when it is in a correct position. Therefore, deterioration in productivity can be prevented.

While the preferred embodiment of the present invention has been described above, the present invention is not restricted to the embodiment.

For example, while three holes are formed on the timing plate in the preferred embodiment, any number of holes may be provided. Furthermore, the number of the cams provided in the cam shaft 22 is not restricted to three. Additionally, switching from the operation mode to the inching mode may be carried out by turning on a power switch while pressing a reset switch. Moreover, the reset switch is not restricted; but another switch may be used. In the inching mode, furthermore, the operation may be stopped in each timing and the reset switch may be pressed to proceed to a next step.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A controller in a banding packing machine, comprising:

a cam shaft on which a plurality of cams are integrally attached in predetermined intervals and which is rotated upon receipt of force from a driving source;

one or more cam followers which are disposed to abut on periphery surfaces of the plurality of cams;

a timing plate integrally provided on the cam shaft, the timing plate having a plurality of holes formed thereon which correspond to a predetermined position such that a plurality of rotation positions of the cam shaft can be detected, wherein each of a band feeding process, a band returning process and a band bonding process in the banding packing machine corresponds to at least one of the holes;

a right presser member which rotatable supports the cam follower;

a left presser member which rotatable supports the cam follower;

a middle presser member which rotatable supports the cam follower;

a detecting means for detecting that each of the plurality of holes formed on the timing plate has reached the predetermined position; and an inching mode capable of stopping the rotation of the cam shaft when the detecting means detects every hole formed on the timing plate, and permits the manual adjustment of each of one or more presser members and the cam shaft.

2. The controller in a banding packing machine according to claim 1, wherein the inching mode is switchable with an operation mode, said operation mode causing the detecting means to detect the plurality of holes formed on the timing plate, thereby driving the cam shaft in a normal cycle.

* * * * *